United States Patent [19]

Cogan et al.

[11] Patent Number: 4,889,241

[45] Date of Patent: Dec. 26, 1989

[54] DISCHARGE CHUTE WITH VARIABLE SLOPE BOTTOM FOR FRAGILE ARTICLE SORTING SYSTEM

[75] Inventors: Kevin C. Cogan, Carrollton; Robert M. Echols, Copper Canyon, both of Tex.

[73] Assignee: Frito-Lay, Inc., Dallas, Tex.

[21] Appl. No.: 126,728

[22] Filed: Nov. 30, 1987

[51] Int. Cl.[4] ..... B07C 5/342

[52] U.S. Cl. ..... 209/552; 193/2 R; 198/560; 209/580; 209/639; 209/924

[58] Field of Search ..... 209/576, 577, 580–582, 209/587, 509, 539, 638, 639, 642–644, 631, 911, 924, 641, 707, 933, 552; 198/560, 367, 438, 640; 193/2 R, 7, 38, 39

[56] References Cited

U.S. PATENT DOCUMENTS

| | | | |
|---|---|---|---|
| 1,641,998 | 9/1927 | Van Der Horst | 193/32 |
| 1,908,722 | 5/1933 | Yeakel | 193/2 R |
| 3,482,686 | 12/1968 | Wood | 209/639 X |
| 3,635,326 | 1/1972 | Langlinais | 198/560 |
| 3,865,965 | 2/1975 | Davis et al. | 426/519 |
| 3,977,526 | 8/1976 | Gordon et al. | 209/639 X |
| 4,091,931 | 5/1978 | Button et al. | 209/580 X |
| 4,136,781 | 1/1979 | Perry et al. | 209/552 |
| 4,147,619 | 4/1979 | Wassmer et al. | 209/580 X |
| 4,236,640 | 12/1980 | Knight | 209/587 |
| 4,313,535 | 2/1982 | Carmichael | 198/766 |
| 4,469,218 | 9/1984 | Cossé | 198/438 |
| 4,485,912 | 12/1984 | Carmichael et al. | 198/382 |
| 4,520,702 | 6/1985 | Davis et al. | 83/71 |
| 4,581,632 | 4/1986 | Davis et al. | 358/106 |

FOREIGN PATENT DOCUMENTS

| | | | |
|---|---|---|---|
| 3604806 | 8/1987 | Fed. Rep. of Germany | 209/539 |
| 0214287 | 10/1984 | German Democratic Rep. | 209/581 |
| 499194 | 4/1976 | U.S.S.R. | 196/560 |

*Primary Examiner*—Robert B. Reeves
*Assistant Examiner*—Donald T. Hajec
*Attorney, Agent, or Firm*—Bernard, Rothwell & Brown

[57] ABSTRACT

An optical inspection machine has a discharge chute provided for receiving fragile articles thrown from a high speed belt in the course of ejecting such articles. The chute has an "S"-shaped bottom with the top of the "S" under the trajectory of the ejected articles, the mid portion of the "S" positioned to receive the falling articles at a minimum impact angle, and the bottom of the "S" discharging the sliding articles after being significantly decelerated due to the variable slope of the "S"-shaped chute bottom. The inspection machine has another "S"-shaped chute for receiving articles from an infeed conveyor and transferring them to the high speed belt while minimizing deceleration.

5 Claims, 1 Drawing Sheet

DISCHARGE CHUTE WITH VARIABLE SLOPE BOTTOM FOR FRAGILE ARTICLE SORTING SYSTEM

BACKGROUND OF THE INVENTION

1. Field of the Invention

This invention relates to improvements in the infeed and discharge receiver for high speed vision system sorting apparatus used to sort fragile articles such as potato chips. More particularly, this invention relates to infeed and receiving chute members having a variable slope and set in a predetermined position to catch and adequately control deceleration of the fragile articles and to prevent undue breakage of the fragile articles.

2. Background and Prior Art

In the production of potato chips on an industrial scale, it is known to utilize a vision inspection system to inspect potato chips visually and then reject those which are not up to visual standards. Typical rejection mechanisms utilize a line of air nozzles operated in accordance with processed signals indicating whether the chips should be rejected or not. The chips travel on a a high speed inspection conveyor during the inspection. Such a machine is sold under the trademark OPTI-SORT manufactured by Simco-Ramic. A patent illustrating one such optical inspection system is U.S. Pat. No. 4,581,632.

In adapting the Simco-Ramic OPTI-SORT machine to potato chips the chips travel in a monolayer on a rapidly moving inspection conveyor. The inspection conveyor is traveling at such a relatively high rate of speed that all chips are thrown from the end of the conveyor and follow a known trajectory. Air from an air reject module is used to reject chips by blowing them out of the trajectory that acceptable chips follow. In the Simco-Ramic approach the acceptable chips then land on another conveyor which decelerates the speed of the chips to a more appropriate speed for further processing.

Another known means of catching and decelerating acceptable chips in a similar type environment utilizing an optical inspection device is with a rigid flat bottom chute positioned in the path of acceptable chips. However, in practice it was found that the use of an ordinary flat bottom chute can contribute to product breakage. Furthermore, it does not decelerate the product effectively.

The use of the known deceleration conveyor also causes breakage since the chips hit the belt at an angle while traveling at a high rate of speed. Moreover, the flat belt conveyor used as a landing area for the non-defective product requires energy to operate; requires maintenance; and contributes to excessive length of the inspection station equipment and excessive use of floor space.

Accordingly, there is need in the art for an effective means of receiving acceptable chips from an optical sorting machine which does not cause undue breakage; does not take excessive floor space; and which provides for control of deceleration.

SUMMARY OF THE INVENTION

This invention is in combination with a sorting machine for sorting lightweight fragile items having a large surface area such as potato chips, the sorting machine being of the type having an inspection conveyor traveling at a high speed on which the chips to be inspected by inspection means are thrown from the end of the conveyor into space and an air nozzle reject selecting means is operative to direct the blast of air against the rejected chips to change their trajectory after being rejected from the end of the inspection conveyor. The improvements of this invention are primarily in the receiving means for receiving acceptable (non-rejected) chips to minimize breakage; to take up a small amount of space; and to decelerate the speed of the acceptable items. This receiving means includes a generally "S"-shaped stationary chute having a variable slope between the top and the bottom of the "S". The chute is supported spaced from the end of the conveyor so as to be in the trajectory of the acceptable chips and out of the trajectory of unacceptable chips. The chute is positioned so that the variable slope presents a minimum impact angle to the path of the acceptable items and the bottom of the "S"-shaped chute is shaped to allow efficient deceleration and removal of the acceptable chips for further processing. A similar "S"-shaped chute with a short transition length to avoid decelerating product prior to entering the high speed inspection conveyor is also utilized, and has the added advantage of spreading the chips out and preventing formation of clumps which would interfere with the vision inspection system.

DETAILED DESCRIPTION OF THE PREFERRED EMBODIMENT

Figure 1:
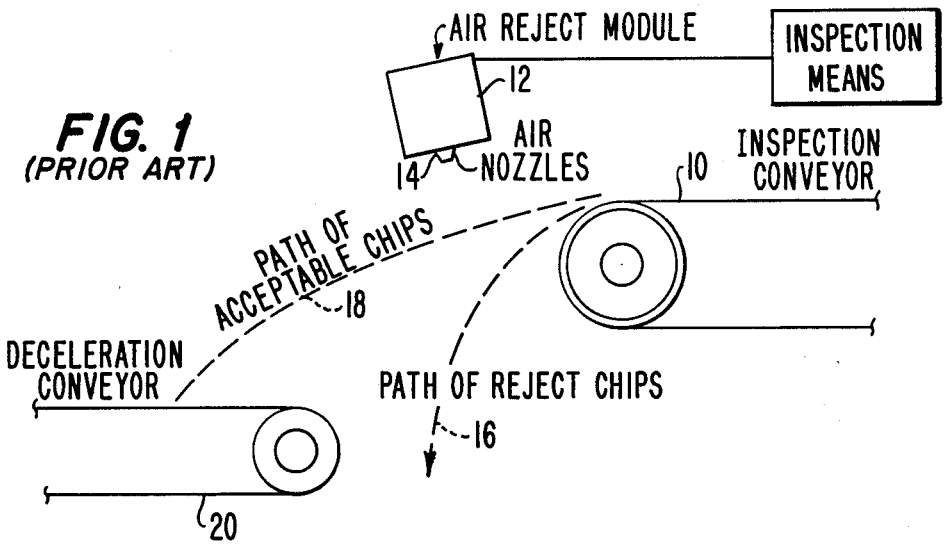
FIG. 1 (PRIOR ART)
FIG. 1 is a schematic illustration of the known prior art arrangement.

The prior art shown in FIG. 1 is a portion of an optical inspection machine including an inspection conveyor 10 on which products (for example potato chips) to be inspected are moved in a single layer (monolayer) rapidly past a visual inspection means. The visual inspection means is connected to an air reject module 12 having an air nozzle means 14 so that individual chips which do not pass visual inspection are rejected by selective blasts across the width of the inspection station from the air nozzle. The air nozzle means includes a large number of individual nozzles to precisely blow rejected chips from the trajectory. The air from selected nozzles changes the trajectory of the chips thrown into space off the end of the fast moving conveyor 10 so that the path of rejected chips is shown in dashed line 16 and the path of acceptable chips is shown in dashed line 18. The acceptable chips land on a slower moving deceleration conveyor 20 which decelerates the speed of the inspected acceptable chips to a point which is typical and appropriate for further processing. As a non-limiting example, the landing speed of the acceptable chips as they are impacting onto the conveyor is at a speed of about 380 feet a minute, and this causes undue breakage. Additionally, any moving conveyor will require energy and maintenance and in this case also requires space because the chips must be decelerated to a final exit speed of around 100 feet per minute for further chip processing.

A similar problem exists with flat bottom or plate-like chutes even when positioned at an angle in the path of acceptable chips, and in using such chutes the breakage rate may be higher.

Figure 2:
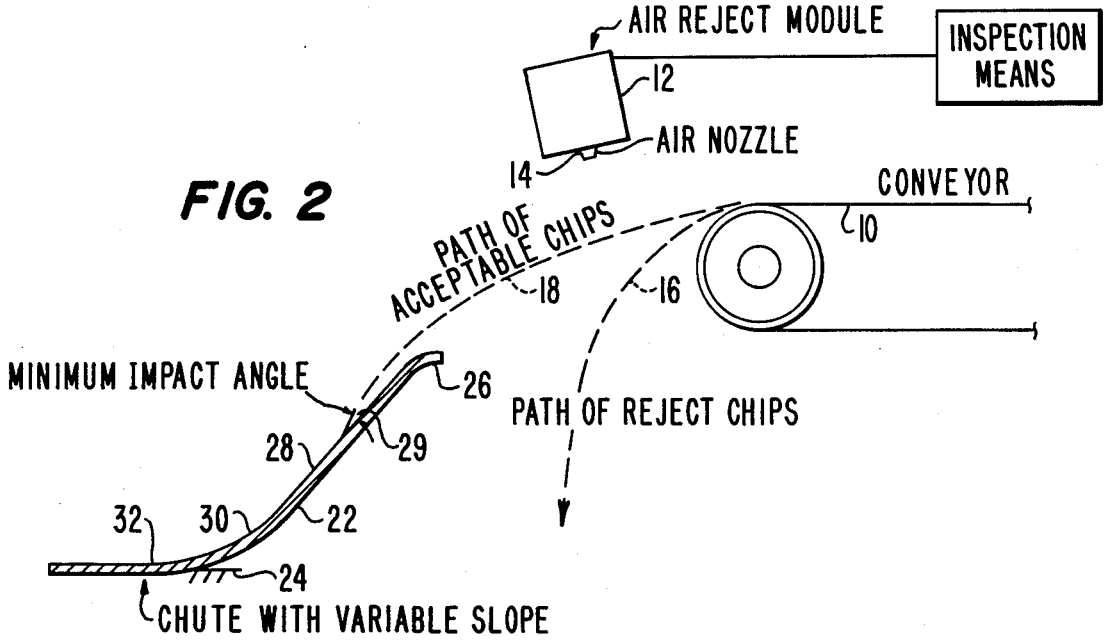
FIG. 2 is a schematic illustration of this invention.

This invention provides a unique solution to the vexing problems of breakage of acceptable chips and of obtaining sufficient deceleration in a short space. FIG. 2 is a schematic illustration of the invention. The inspection conveyor 10, air reject module 12 and air nozzle means (multiple nozzles) 14 are the same as in the prior art visual inspection machine described above. Similarly, the path of the trajectory of the acceptable chips and rejected chips is the same as FIG. 1 and the same reference numbers are used to indicate the same. The feature of this invention is a chute 22 which is generally "S"-shaped and having a variable slope. The chute is fixedly mounted by suitable mounting means schematically illustrated at 24 and is positioned so that an upper end 26 of the "S"-shaped chute bottom is underneath the path of the acceptable chips and out of the path of the rejected chips. A generally flat central portion 28 of the chute is positioned so as to create a minimum, i.e., very small, impact angle 29. The impact angle is the angle between the chute portion 28 and the end of the trajectory of acceptable chips where they impact the chute. The optimum impact angle should be as close to 0° as possible, and in any event should be less than about 20°. The central portion 28 of the chute is almost parallel to the path of the acceptable chips so that on impact the acceptable chips do not hit at a large angle but rather slide down the portion 28 of the chute. Below the portion 28 is a portion 30 where the slope of the chute changes and the variable slope between these portions has the effect of decelerating the chips. The chips continue their path on a portion 32 at the bottom of the chute which is preferably and generally approximately horizontal. The chute allows the speed of the acceptable chips to decelerate (e.g., from 350–380 feet per minute) to the final speed at the exit of the chute (approximately 100 feet per minute). The chips then pass on to another conveyor for appropriate further processing.

The chips which are thrown off of the inspection conveyor travel in flight in space toward the chute 22 at an approximate parabolic trajectory. The portion of the chute where the chips first make contact, section 28, is steeply sloped to match the flight angle of the chips. By maintaining a small impact angle 29 the chute allows the chips to land smoothly and with minimum breakage. As the chips slide down the chute they encounter a decreasing slope on the chute, and because of the smaller slope at the discharge end of the chute the chips are slowed down considerably from the initial speed. The slower product speed allows the chips to transfer from the chute into any subsequent equipment with minimum breakage.

In tests on production equipment, by way of a non-limiting example, a product flow of between 1250–1500 pounds per hour was run through an OPTI-SORT inspection machine and left the inspection conveyor at about 380 feet per minute. The chips were decelerated by the chute alone to about 150 feet per minute. With the air reject system enabled, product breakage was as low as 0.15%. The top of the "S"-shaped chute was 3½ inches below the top of the inspection conveyor and 6½ inches from the end of the inspection belt with the steeply shaped portion of the chute at an angle of 45%.

Figure 3:
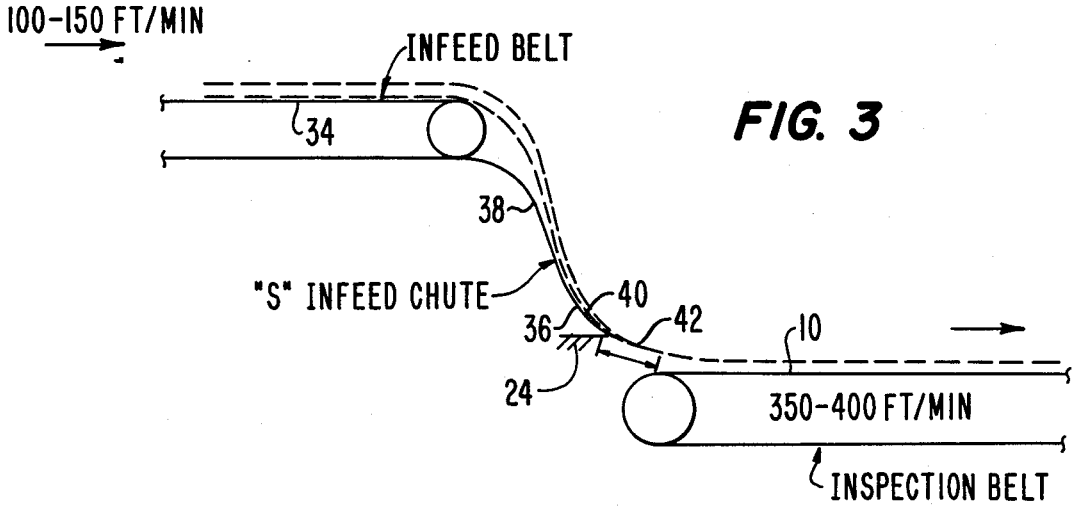
FIG. 3 is a schematic illustration of the use of this invention as an infeed chute.

FIG. 3 shows the use of the "S"-shaped chute for the infeed of the inspection conveyor 10. At the entrance end of the inspection machine the chips are traveling in a bed 2–3 chips deep on an infeed conveyor 34 which is positioned above and spaced from the inspection conveyor 10. Typically the inspection conveyor 10 is traveling at 2–3 times the speed of the infeed conveyor so that the chips which are 2–3 chips deep on the infeed conveyor are monolayered (formed in a single layer) on the inspection conveyor. The vision inspection system operates best when inspecting a monolayer of chips without clumps. As non-limiting examples, the infeed conveyor may be traveling at 100–150 feet per minute and the inspection conveyor is traveling at 350–400 feet per minute.

An "S"-shaped infeed chute 36 is provided between conveyors 34 and 10 as shown in FIG. 3. The chute 36 has portion 38 to receive the chips thrown off the end of the conveyor 34 at a minimum impact angle. The chips then slide down a central portion 40 of the "S"-shaped chute 36 and into a short transition length 42. The transition length is short to avoid decelerating the chips prior to entering the high speed inspection conveyor 10. The chips spread out during their fall onto portion 38 of the chute 36. In addition to reducing chip breakage, the infeed chute 36 has the added benefit of spreading out the chips coming from the layered bed of chips on conveyor 34 and preventing the formation of clumps of chips which would interfere with the vision inspection system.

As can be seen, this invention discloses an extremely simple but highly effective means for preventing breakage of chips normally associated with high speed inspection. It also allows quick and efficient control of deceleration of such chips in a relatively short while eliminating the problems of the prior art.

Although the invention is described with regard to the preferred embodiment, namely, potato chips, there is no reason that it would not also be applicable to similar lightweight fragile articles.

We claim:

1. In combination with a sorting machine for sorting lightweight fragile items having a large surface area, a sorting machine having an inspection conveyor travelling at a high speed on which items are inspected by inspection means and then thrown from the end of the conveyor into space, air nozzle rejected item selection means for separation of acceptable items from rejected items operative from the inspection means to direct a blast of air against rejected items to change their trajectory after being ejected from the end of the inspection conveyor, with improved receiving means for receiving acceptable items to minimize breakage and to decelerate the speed of the acceptable items, the receiving means comprising:

(a) a stationary chute having a generally "S" shape with a variable slope between the top and the lower portion of the "S", (b) means supporting the chute spaced from and below the end of the conveyor so as to be in the trajectory of acceptable items and out of the trajectory of rejected items, (c) means positioning the cute so that an intermediate portion of the variable slope presents a minimum impact angle to the path of acceptable items, (d) the lower portion of the bottom of the "S"-shaped chute shaped in a generally horizontal line to allow efficient removal of the accepted items.

2. A device as defined in claim 1 wherein the impact angle of said chute is less than about 20°.

3. In combination with a sorting machine for sorting lightweight fragile items having a large surface area, a sorting machine having an inspection conveyor travelling at a high speed on which items are inspected by inspection means and then thrown from the end of the conveyor into space, air nozzle rejected item selection means for separation of acceptable items from rejected items operative from the inspection means to direct a blast of air against rejected items to change their trajectory after being ejected from the end of the inspection conveyor, with improved receiving means for receiving acceptable items to minimize breakage and to decelerate the speed of the acceptable items, the receiving means comprising:

(a) a stationary chute having a generally "S" shape with a variable slope between the top and the lower portion of the "S", (b) means supporting the chute spaced from and below the end of the conveyor so as to be in the trajectory of acceptable items and out of the trajectory of rejected items, (c) means positioning the chute so that an intermediate portion of the variable shape slope presents a minimum impact angle to the path of acceptable items, (d) the lower portion of the bottom of the "S"-shaped chute shaped in a generally horizontal line to allow efficient removal of the accepted items.

wherein the sorting machine is fed by an infeed conveyor travelling substantially slower that the inspection conveyor, with further improvements comprising, another stationary chute having a generally "S" -shape with a variable slope between the top and bottom of the "S" positioned supported between the infeed conveyor and the inspection conveyor such that items thrown off the end of the feed conveyor contact the chute at a minimum impact angle and the lower portion of the bottom of the "S" is short to avoid substantial deceleration of the items prior to entering the inspection conveyor.

4. A device as defined in claim 3 wherein the impact angle of each of said chutes is less than about 20°.

5. A method of controlling deceleration of lightweight articles in connection with a visual inspection station means which accomplishes inspection at a high rate of speed, and selection means responsive to the inspection station means for the separation of rejected articles from non-rejected articles the method comprising:

(a) catching articles thrown into space from an infeed conveyor upon a sloped surface, the sloped surface corresponding roughly with the path of the thrown articles at a minimum impact angle, (b) allowing the articles to slide by gravity on the sloped surface and minimizing deceleration of the articles, (c) depositing the articles onto an inspection conveyor moving faster than the infeed conveyor, the articles being spread upon the inspection conveyor and thereby preventing clumps of articles being deposited onto the inspection conveyor, (d) catching non-rejected articles thrown into space from said inspection conveyor upon a second sloped surface corresponding roughly with the path of the non-rejected articles and thereby creating a minimum impact angle, (e) allowing the non-rejected articles so caught to move by gravity but at decreasing angles to the horizontal, and (f) decelerating the speed of the articles by their further movement on the second sloped surface.

* * * * *

UNITED STATES PATENT AND TRADEMARK OFFICE

CERTIFICATE OF CORRECTION

PATENT NO. : 4,889,241

DATED : December 26, 1989

INVENTOR(S) : Kevin C. COGAN and Robert M. ECHOLS

It is certified that error appears in the above-identified patent and that said Letters Patent is hereby corrected as shown below:

Column 1, line 23, delete "a" (second occurrence);

Column 4, line 58, delete "cute" and substitute therefor -- chute --;

Column 5, line 27, delete "that" and substitute therefor -- than --;

Column 5, line 31, after "positioned" insert -- and --.

Signed and Sealed this

Twenty-first Day of May, 1991

*Attest:*

*Attesting Officer*

HARRY F. MANBECK, JR.

*Commissioner of Patents and Trademarks*